US009363592B2

(12) United States Patent
Wen et al.

(10) Patent No.: US 9,363,592 B2
(45) Date of Patent: Jun. 7, 2016

(54) LED LIGHTING DEVICE AND SPEAKER

(71) Applicant: ZHEJIANG SHENGHUI LIGHTING CO., LTD, Jiaxing (CN)

(72) Inventors: Caifang Wen, Jiaxing (CN); Xia Wang, Jiaxing (CN); Jinxiang Shen, Jiaxing (CN)

(73) Assignee: ZHEJIANG SHENGHUI LIGHTING CO., LTD, Jiaxing (CN)

( * ) Notice: Subject to any disclaimer, the term of this patent is extended or adjusted under 35 U.S.C. 154(b) by 8 days.

(21) Appl. No.: 14/488,772

(22) Filed: Sep. 17, 2014

(65) Prior Publication Data

US 2015/0036863 A1 Feb. 5, 2015

Related U.S. Application Data

(63) Continuation of application No. PCT/CN2014/082061, filed on Jul. 11, 2014.

(30) Foreign Application Priority Data

Aug. 1, 2013 (CN) ..... 2013 1 0332830

(51) Int. Cl.

| | |
|---|---|
| ***H04R 1/02*** | (2006.01) |
| ***F21V 33/00*** | (2006.01) |
| ***F21K 99/00*** | (2016.01) |
| ***F21V 23/00*** | (2015.01) |
| *H04R 9/02* | (2006.01) |
| *H04R 1/28* | (2006.01) |

(52) U.S. Cl.

CPC ..... *H04R 1/028* (2013.01); *F21K 9/1355* (2013.01); *F21V 23/009* (2013.01); *F21V 33/0056* (2013.01); *H04R 1/2803* (2013.01); *H04R 9/022* (2013.01)

(58) Field of Classification Search

CPC ..... H04R 1/025; H04R 7/045
USPC ..... 381/386, 397, 172
See application file for complete search history.

(56) References Cited

U.S. PATENT DOCUMENTS

| | | | | |
|---|---|---|---|---|
| 7,997,772 | B2 * | 8/2011 | Avtzon | F21S 6/001 362/161 |
| 2008/0285271 | A1 * | 11/2008 | Roberge | F21S 8/033 362/235 |
| 2009/0034778 | A1 * | 2/2009 | Chi | H04R 1/028 381/394 |
| 2009/0050615 | A1 * | 2/2009 | Fis-Menache | F24C 1/10 219/209 |

(Continued)

*Primary Examiner* — Jesse Elbin
*Assistant Examiner* — Julie X Dang
(74) *Attorney, Agent, or Firm* — Anova Law Group, PLLC

(57) ABSTRACT

Embodiments consistent with the present disclosure provide an LED lighting device and speaker. The LED lighting device and speaker may include an LED lighting unit, a speaker, an outer casing, and a power supply module. The LED lighting unit and the speaker are placed on the outer casing. There is also a sound guiding tube on the outer casing. The sound guiding tube on the outer casing may expand the audio bandwidth, enhance bass quality, reduce speaker vibration displacements, and protect the speaker. Further, the gap between the sound guiding tube and the bottom of the outer casing provides a heat dissipation path for the heat generated by the power supply module. In addition, the sound guiding tube and the hollowed lampshade forms a path that increases the air circulation between the interior and exterior of the LED lighting device and speaker. Finally, the sound guiding tube adds to the heating dissipating surface of the LED lighting device and speaker and therefore improves the efficiency of heat dissipation.

19 Claims, 3 Drawing Sheets

(56) References Cited

U.S. PATENT DOCUMENTS

2010/0142330 A1* 6/2010 Reygaert ..... A61J 7/0481 368/10

2011/0317846 A1* 12/2011 Yuan ..... F21V 33/0056 381/77

2013/0294050 A1* 11/2013 Lee ..... G08C 17/02 362/86

* cited by examiner

LED LIGHTING DEVICE AND SPEAKER

CROSS-REFERENCES TO RELATED APPLICATIONS

This application is a continuation application of PCT Patent Application No. PCT/CN2014/082061, filed on Jul. 11, 2014, which claims the priority of Chinese Patent Application No. 201310332830X, filed on Aug. 1, 2013, the entire content of which is incorporated herein by reference.

FIELD OF THE DISCLOSURE

The present disclosure relates to the field of light emitting diode (LED) technologies and, more particularly, relates to an LED lighting device and speaker.

BACKGROUND

LEDs provide controllable lighting and solid-state lighting. They consume less power than traditional lighting devices, and are environmentally friendly. Over time, LEDs have been widely used for various lighting applications such as public place lightings, office and indoor lightings, etc.

Speakers play an important role in modern daily life entertainment. To provide lighting and play music at the same time, current LED lighting device and speaker designs combine speakers and LEDs into one integrated device. However, the present designs of such devices often simply place a speaker onto an LED lighting device to provide lighting and audio playing capabilities. As a result, the resulting device often has poor heat dissipation capacity, low quality bass, and may be difficult to manufacture.

The present disclosure is directed to solve one or more problems set forth above and other problems.

BRIEF SUMMARY OF THE DISCLOSURE

Embodiments consistent with the present disclosure provide an LED lighting device and a speaker. This LED lighting device and speaker may deliver high quality bass, and dissipate heat efficiently. This LED lighting device and speaker also have a simplified structure.

In one embodiment, an LED lighting device and speaker includes an LED lighting unit configured to emit light, a speaker configured to play audio signals, an outer casing configured to hold the LED lighting unit and speaker, and a power supply module configured to supply power to the LED lighting unit and speaker. Further, the LED lighting unit and the speaker are fixed on a top surface of the outer casing by screws. The outer casing includes a sound guiding tube.

Moreover, the outer casing and the sound guiding tube may be fully integrated. The outer casing may have a hollow structure and a concave top surface. The sound guiding tube may run through the top surface of the outer casing. One end of the sound guiding tube may protrude above the top surface of the outer casing. The other end of the sound guiding tube may extend toward a bottom surface of the outer casing and maintain a gap between itself and the bottom surface.

In addition, the LED lighting unit and the speaker may be set on the top surface of the outer casing by screws. The sound guiding tube may have a hollow structure with both ends being open. The cross section of the sound guiding tube may be round. The lampshade has a hollowed out design and snaps into the outer casing.

Finally, the power supply module may include a power supply, a base with a hollow interior, and a light socket. The outer casing may be connected to the base. The power supply may be placed in the base. The power supply may be connected to the light socket and to the LED lighting unit. The base may be connected to the outer casing by screws.

Embodiments consistent with the present disclosure may expand the audio bandwidth of the speaker, enhance the quality of bass, and reduce speaker vibration displacements, which protects the speaker. Further, the gap between the sound guiding tube and the bottom of the outer casing provides a heat dissipation path for the heat generated by the power supply module. In addition, the sound guiding tube and the hollowed lampshade forms a path that increases the air circulation between the interior and exterior of the LED lighting device and speaker. Finally, the sound guiding tube adds to the heating dissipating surface of the LED lighting device and speaker and therefore improves the efficiency of heat dissipation.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1:
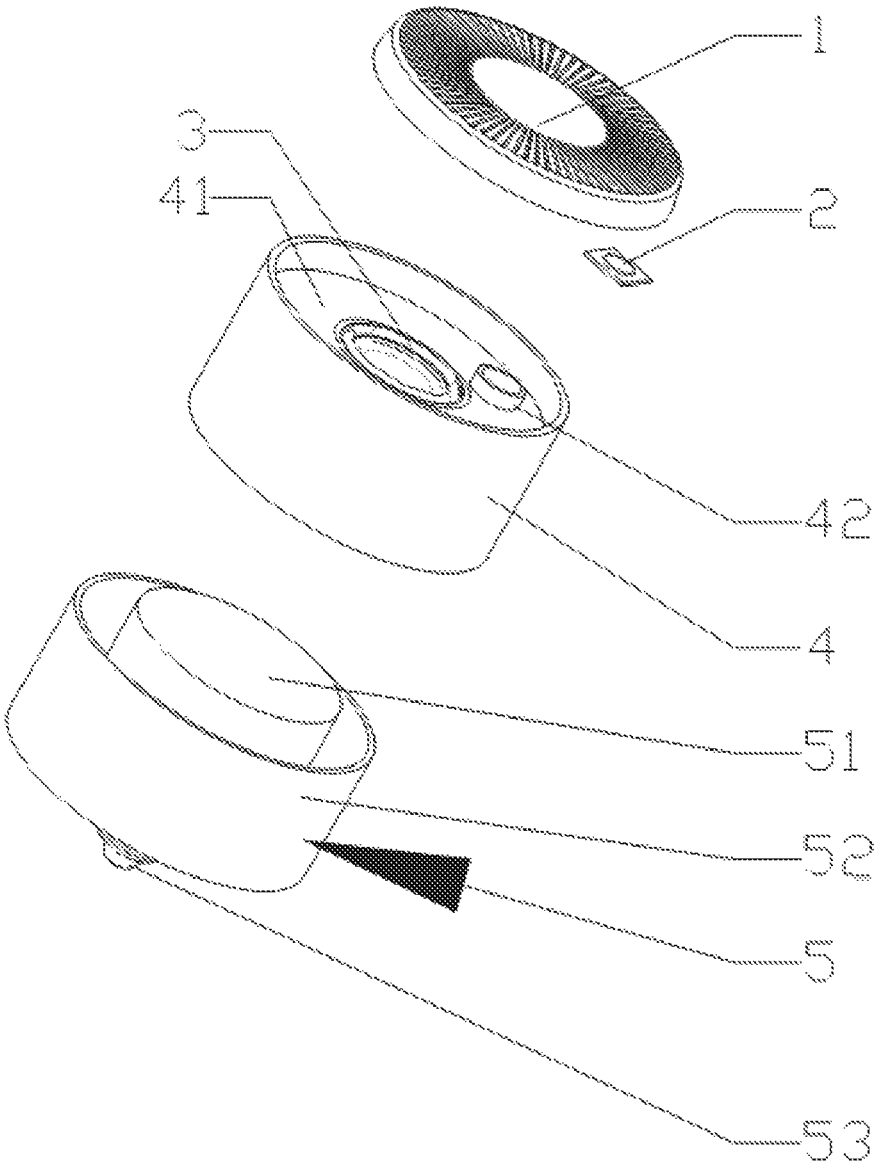
FIG. 1 is an exploded view of an exemplary LED lighting device and speaker consistent with various embodiments of the present disclosure.

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiment, persons of ordinary skill in the art may derive other embodiments consistent with the present disclosure, all of which are within the scope of the present invention.

An exemplary embodiment consistent with the present disclosure is described below. FIG. 1 to FIG. 4 illustrate an exemplary configuration of an LED lighting device and speaker consistent with the present disclosure. The LED lighting device and speaker may include a lampshade 1, an LED lighting unit 2, a speaker 3, an outer casing 4, and a power supply module 5. The power supply module 5 may further include a power supply 51, a base 52, and a light socket 53.

As shown in FIG. 1, the base 52 may have a hollow interior. The power supply 51 may be placed inside the base 52. The power supply 51 may be connected to the light socket 53 and the LED lighting unit 2.

In this embodiment, the outer casing 4 may be a cylinder with a hollow interior and a concave top surface 41. The LED lighting unit 2 and the speaker 3 may be fixed to the top surface 41 by screws (not shown here). The lampshade 1 may snap into the outer casing 4. The snap structure may use designs that are well known to those skilled in the art. The base 52 and the outer casing 4 may be connected together by screws.

Figure 2:
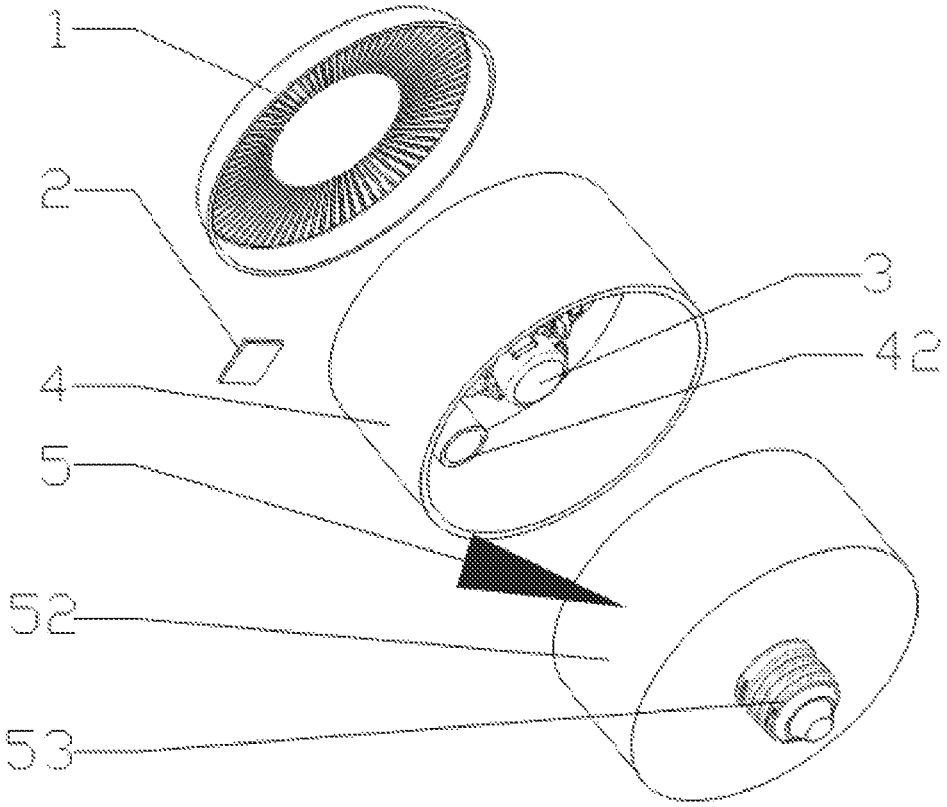
FIG. 2 is an exploded view from another viewpoint of an exemplary LED lighting device and speaker consistent with various embodiments of the present disclosure.
Figure 3:
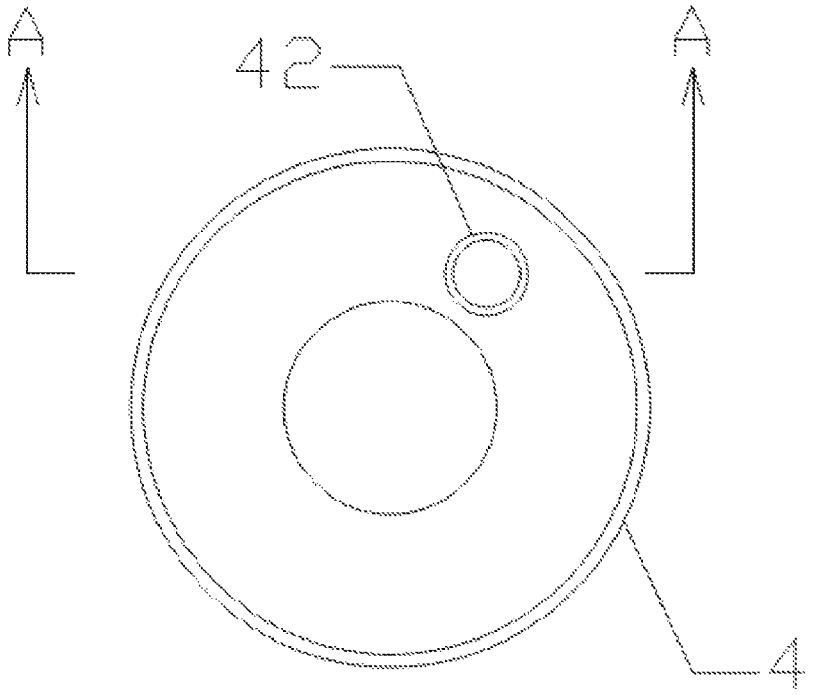
FIG. 3 is a schematic illustrating the structure of the outer casing of an exemplary LED lighting device and speaker consistent with various embodiments of the present disclosure.
Figure 4:
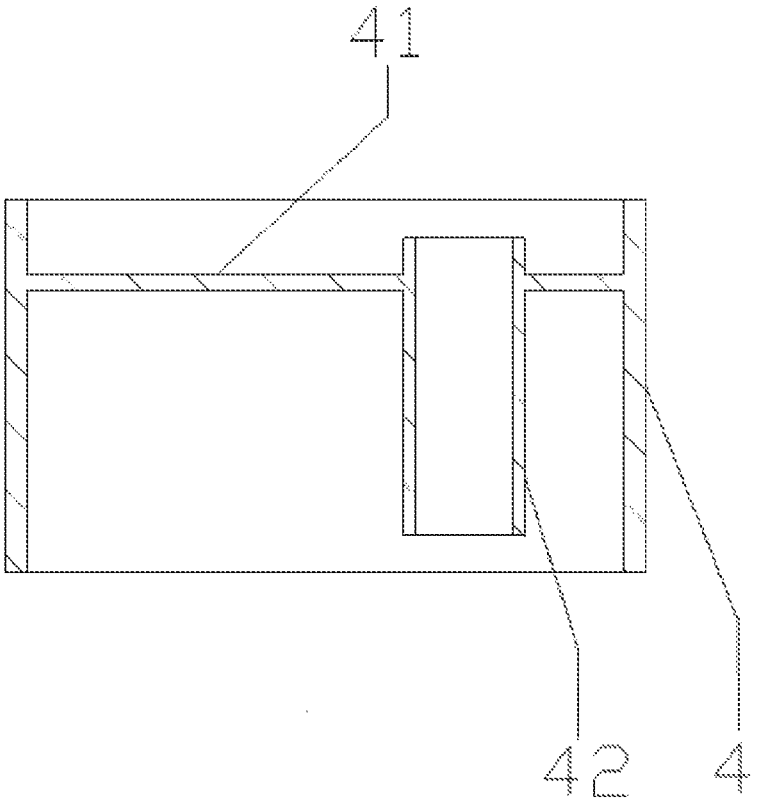
FIG. 4 is the A-A cross sectional view of the structure of the outer casing of an exemplary LED lighting device and speaker consistent with various embodiments of the present disclosure.

As shown in FIG. 1, FIG. 2 and FIG. 4, the outer casing 4 may include a sound guiding tube 42. The sound guiding tube 42 may be integrated together with the outer casing 4 as one piece. One end of the sound guiding tube 42 may protrude out of the top surface 41. The other end of the sound guiding tube 42 may extend toward the bottom surface of the outer casing 4, but stay above the bottom surface. As a result, a gap may be formed between the lower end of the sound guiding tube 42 and the bottom surface of the outer casing 4.

The sound guiding tube 42 may have a circular shaped cross section as shown in this embodiment. The sound guide tube 42 may be designed to use tubes of different cross sectional shapes such as square, polygon, etc. Moreover, the sound guiding tube 42 may expand the audio bandwidth of the speaker and may improve its bass quality. The sound guide tube 42 may also reduce the vibration displacement of the speaker 3, which may better protect the speaker 3.

As shown in FIG. 1 and FIG. 2, the lampshade 1 may have a hollowed out design. The sound guiding tube 42 may therefore connect the internal air (of the power supply chamber) to the external air. As a result, heat generated by the power supply 51 may be dissipated efficiently through convection. Further, the sound guiding tube 42 adds to the surface area of the outer casing 4, which improves the heat dissipation efficiency.

The design, including the material, shape, size, or position, of the sound guiding tube 42 may be determined based on the internal space of the LED lighting device and speaker, the power of the speaker, the desirable sound effect, etc. For example, the length of the sound guiding tube may be adjusted to achieve better sound quality or better heat dissipation. In another example, multiple sound guiding tubes may also be used to achieve better sound quality or better heat dissipation. Further, the thickness or the material of the sound guiding tube 42 may be selected to improve heat dissipation efficiency. In addition, the position of the sound guiding tube 42 may also be adjusted to achieve better vibration displacement reduction.

Other embodiments of the disclosure will be apparent to those skilled in the art from consideration of the specification and practice of the invention disclosed herein. It is intended that the specification and examples be considered as exemplary only, with a true scope and spirit of the invention being indicated by the claims.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

In some embodiments consistent with the present disclosure, an RF module may be added to the LED lighting device and speaker. The RF module may enable users to control the LED lighting device and speaker remotely, such as switching the device on/off, adjusting light and sound settings, etc. The RF module may also connect the LED lighting device and speaker to the internet to stream music online.

In some embodiments consistent with the present disclosure, a Bluetooth module may be included in the LED lighting device and speaker. The LED lighting device and speaker may be paired with a smart phone, a tablet, etc. through the Bluetooth module. A user may install an application on the smartphone or tablet to control lighting or play music stored on the device.

In some embodiments consistent with the present disclosure, multiple LED lighting device and speakers may be configured to form 2.0-channel, 2.1-channel, 5.1-channel, etc. audio systems. Further, the LED lighting unit may be configured to change its light colors or light intensities according to the rhythm or volume of the music played through the speaker.

REFERENCE SIGN LIST

Lampshade 1
LED lighting unit 2
Speaker 3
Outer casing 4
Power supply module 5
Top surface of the outer casing 41
Sound guiding tube 42
Power supply 51
Base 52
Light socket 53

What is claimed is:

1. An LED lighting device and speaker, comprising:
an LED lighting unit configured to emit light;
a speaker configured to play audio signals;
an outer casing configured to hold the LED lighting unit and speaker;
a sound guiding tube, running through the outer casing, configured to guide sound and dissipate heat; and
a power supply module configured to supply power to the LED lighting unit and speaker;
wherein:
the outer casing and the sound guiding tube are fully integrated into one piece;
the speaker is fixed to a center of a top surface of the outer casing; and
the speaker is located next to the sound guiding tube.

2. The LED lighting device and speaker according to claim 1, wherein the outer casing has a hollow structure and a concave top surface.

3. The LED lighting device and speaker according to claim 2, wherein the sound guiding tube runs through the top surface of the outer casing, with one end of the sound guiding tube protruding above the top surface of the outer casing, and the other end of the sound guiding tube extending toward a bottom surface of the outer casing and maintaining a gap between itself and the bottom surface.

4. The LED lighting device and speaker according to claim 2, wherein the LED lighting unit and the speaker are both bond on the top surface of the outer casing by screws.

5. The LED lighting device and speaker according to claim 1, wherein the sound guiding tube has a hollow structure, with two open ends.

6. The LED lighting device and speaker according to claim 1, wherein a cross section of the sound guiding tube is round.

7. The LED lighting device and speaker according to claim 1, wherein the lampshade has a hollow design and is snapped into the outer casing.

8. The LED lighting device and speaker according to claim 7, wherein the lampshade, the sound guiding tube, and the outer casing provide an airflow path to dissipate heat generated by the power supply module.

9. The LED lighting device and speaker according to claim 1, wherein the power supply module includes a power supply, a base with a hollow interior, and a light socket.

10. The LED lighting device and speaker according to claim 9, wherein the outer casing is connected to the base; the power supply is placed in the base; and the power supply is connected to the light socket and to the LED lighting unit.

11. The LED lighting device and speaker according to claim 10, wherein the base is connected to the outer casing by screws.

12. A method for heat dissipation and sound guiding in an LED lighting device and speaker, comprising:

emitting light through an LED lighting unit of the LED lighting device and speaker;

playing audio through a speaker of the LED lighting device and speaker; and guiding sound by a sound guiding tube running through an outer casing holding the LED lighting unit and the speaker;

wherein:

the outer casing and the sound guiding tube are fully integrated into one piece;

the speaker is fixed to a center of a top surface of the outer casing; and the speaker is located next to the sound guiding tube.

13. The method for heat dissipation and sound guiding in an LED lighting device and speaker accordingly to claim 12, further comprising:

dissipating heat generated by the LED lighting unit through the sound guiding tube.

14. The method for heat dissipation and sound guiding in an LED lighting device and speaker accordingly to claim 12, wherein the outer casing has a hollow structure and a concave top surface.

15. The method for heat dissipation and sound guiding in an LED lighting device and speaker accordingly to claim 14, wherein the sound guiding tube runs through the top surface of the outer casing, with one end of the sound guiding tube protruding above the top surface of the outer casing, and the other end of the sound guiding tube extending toward a bottom surface of the outer casing and maintaining a gap between itself and the bottom surface.

16. The method for heat dissipation and sound guiding in an LED lighting device and speaker accordingly to claim 12, wherein the sound guiding tube has a hollow structure, with two open ends.

17. An LED lighting device and speaker, comprising:

a lampshade with a hollowed-out structure;

an LED lighting unit configured to emit light;

a speaker configured to play audio signals;

an outer casing configured to hold the LED lighting unit and speaker;

a sound guiding tube running through the outer casing configured to guide sound and dissipate heat; and a power supply module configured to supply power to the LED lighting unit and speaker;

wherein:

the outer casing, the sound guiding tube, and the lampshade form an airflow path to dissipate heat generated by the power supply module and to guide sound played by the speaker;

the outer casing and the sound guiding tube are fully integrated into one piece;

the speaker is fixed to a center of a top surface of the outer casing; and the speaker is located next to the sound guiding tube.

18. The LED lighting device and speaker according to claim 1, wherein:

a shape and a size of the sound guiding tube are determined based on at least two of an internal space of the LED lighting device, a desired sound quality of the speaker, and a desired vibration displacement reduction effect of the speaker.

19. The LED lighting device and speaker according to claim 1, further comprising:

a plurality of the sound guiding tubes.

* * * * *